United States Patent [19]

Burke

[11] Patent Number: 5,018,475

[45] Date of Patent: May 28, 1991

[54] INFLATABLE DINGHY BRACKET

[76] Inventor: Roy D. Burke, R.R. #1, Enniskillen, Ont., Canada, L0B 1H0

[21] Appl. No.: 244,213

[22] Filed: Sep. 14, 1988

[51] Int. Cl.[5] ..... B63B 23/00

[52] U.S. Cl. ..... 114/365; 114/345; 24/600.4

[58] Field of Search ..... 114/172, 203, 294, 216, 114/221 R, 230, 249, 250, 251, 253, 365, 364, 366, 367, 377, 378; 24/238, 241.5 L; 59/84–86, 93, 95; 70/14, 58, 68; 292/95, 137, DIG. 30, 32; 403/341

[56] References Cited

U.S. PATENT DOCUMENTS

| | | | |
|---|---|---|---|
| 3,365,759 | 1/1968 | Molzan et al. | 24/238 |
| 3,442,241 | 5/1969 | Daunis | 114/230 |
| 3,647,089 | 3/1972 | Christensen | 114/373 |
| 3,793,685 | 2/1974 | Knecht | 114/230 |
| 3,834,338 | 9/1974 | Renouf | 114/373 |
| 4,526,126 | 7/1985 | Dunn | 114/365 |

*Primary Examiner*—Sherman D. Basinger
*Assistant Examiner*—Jesus D. Sotelo
*Attorney, Agent, or Firm*—Rogers, Bereskin & Parr

[57] ABSTRACT

A bracket is provided for securing an inflatable dinghy having opposing pontoon portions to a yacht. The bracket comprises a member adatped to fit over one of the pontoon portions, and having at one end thereof an element for removably securing the member to the yacht, and also comprises a mounting assembly for mounting the member to the dinghy such that the member is directly or indirectly held by and between the under parts of the inner sides of the opposing pontoon portions.

20 Claims, 6 Drawing Sheets

INFLATABLE DINGHY BRACKET

This invention relates generally to a bracket for securing an inflatable dinghy to a yacht.

It is common for yachts to tow or to carry a smaller boat or dinghy. To this end yachts are frequently equipped with rings or similar hardward extending rearwardly from the transom or swim deck. A conventional rigid hull dinghy can be secured to such rings by means of hooks fastened to the gunwale of the rigid hull dinghy. With these dinghy hooks in the rings of the yacht, the rigid hull dinghy can be towed or raised completely out of the water and held against the transom of the yacht by means of a hoisting line extending from the yacht down to the outward gunwale of the dinghy.

Conventional rigid hull dinghies are increasingly being replaced by inflatable dinghies. Inflatable dinghies of the "full doughnut" or "O"-shaped configuration which generally carry only small, light weight outboard motors can be secured to rings extending rearwardly from the transom or swim deck of a yacht by means of hooks glued to one side of the inflated pontoon. However, inflatable dinghies having an "open doughnut" or "U"-shaped configuration with a rigid transom extending between two opposing pontoon portions generally carry much more powerful and heavier motors. Hooks which are merely glued to the upper part of the pontoon are susceptible of tearing away in use because of the heavy load of the large motor. Adhesives having sufficient strength and being compatable with the various materials of the pontoon construction also tend to be expensive, and generally have to be applied by a skilled installer.

In answer to these problems, an alternative bracket has been introduced to the North American market. This comprises a pair of elongate arms connected by a cross-member to form an "H", the two arms being hingedly connected at one end to the transom or swim deck of the yacht and having on each arm a pair of clamping members which extend downwardly and inwardly from the arms, the outermost of which pivots upwardly and outwardly to admit the dinghy and then pivots back so that the dinghy is held with the two clamps extending around the outside and underneath the dinghy. This bracket suffers primarily from the disadvantage that it is large and cumbersome, and it interferes with the free enjoyment of the swim deck.

It is an object of the present invention to obviate or mitigate these and other disadvantages of the known art.

In accordance with the present invention, there is provided a bracket for securing an inflatable dinghy having opposing pontoon portions to a yacht, said bracket comprising: a member adapted to fit over one of said pontoon portions, and having at one end thereof securing means for removably securing said member to said yacht; and mounting means for mounting said member to said dinghy such that said member is directly or indirectly held by and between the under parts of the inner sides of said opposing pontoon portions. In one preferred embodiment for use on a dinghy having a rigid transom held at least partially by and between the under parts of the inner sides of opposing pontoon portions, the mounting means comprises fastening means for fastening the member to the transom. In another preferred embodiment for use on a dinghy having a rigid floor held at least partially by and between the under parts of the inner sides of opposing pontoon portions, the mounting means comprises fastening means for fastening the member to the floor. Most preferably, these fastening means comprise threaded fasteners. In another preferred embodiment, the mounting means comprises a base which is adapted to fit between and be held by the under parts of the inner sides of the pontoon portions and the member extends upwardly from the base. Where the bracket is for use with a yacht having rings mounted to its transom or swim deck, the securing means advantageously comprises a clasp adapted to fit on to such a ring, the clasp comprising a bar having a transverse notch extending inwardly on one side thereof and adapted to receive the ring, and a latch mounted to the bar movable between a first position and a second position and having a part which extends across and closes the notch when the latch is in the first position and which is withdrawn and leaves open the notch when the latch is in the second position.

It has been found that a bracket of the present invention can be sufficiently strong to secure a dinghy with a large outboard motor reliably. Furthermore, such a bracket may have a relatively simple and inexpensive construction. In addition, such a bracket can be small, easy to use, and unobtrusive.

In order that the invention may be more clearly understood, reference will now be made to the accompanying drawings which illustrate preferred embodiments and in which.

Figure 1:
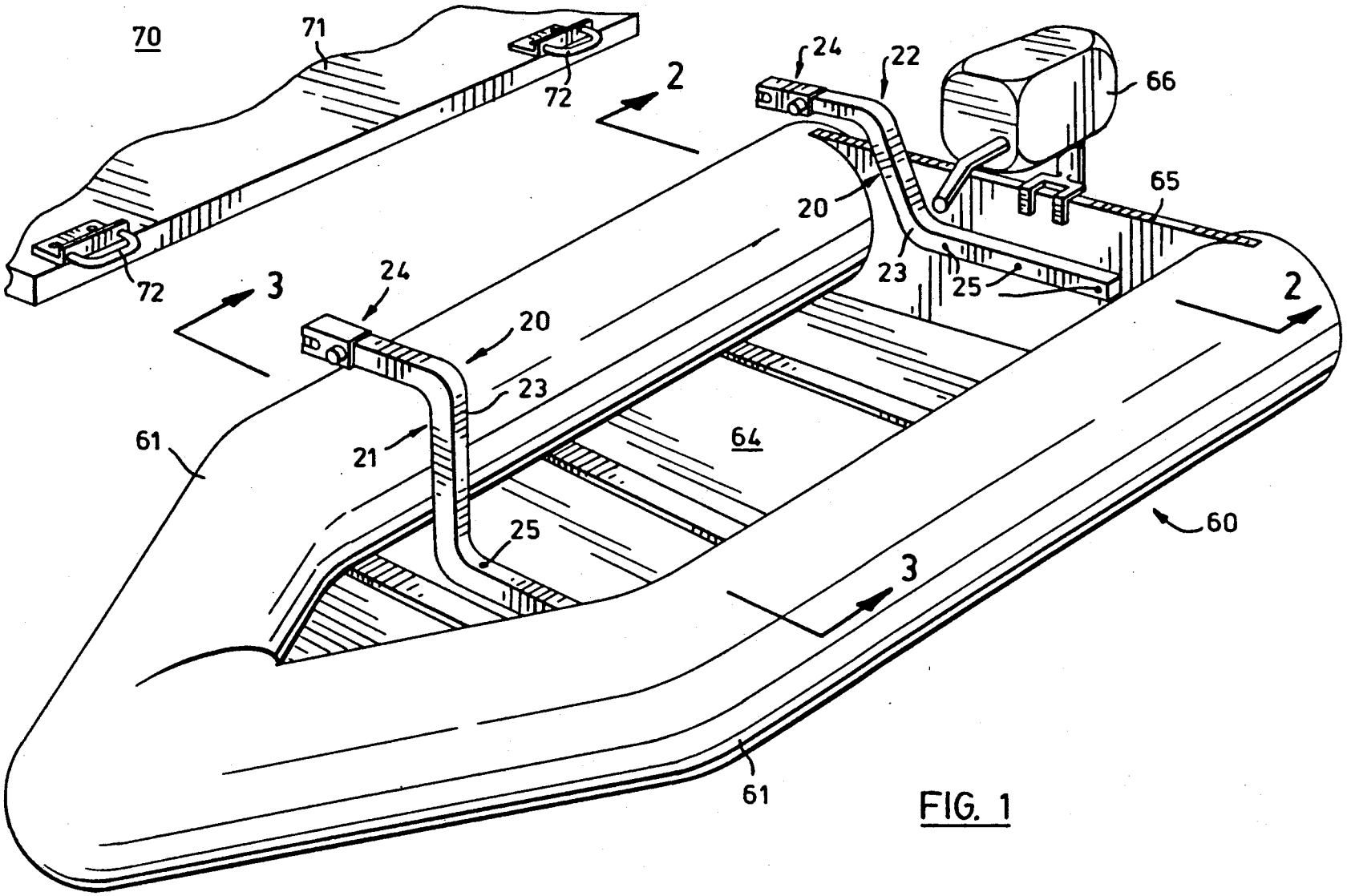
FIG. 1 is a perspective view of an inflatable dinghy equiped with brackets of two embodiments of the present invention.
Figure 2:
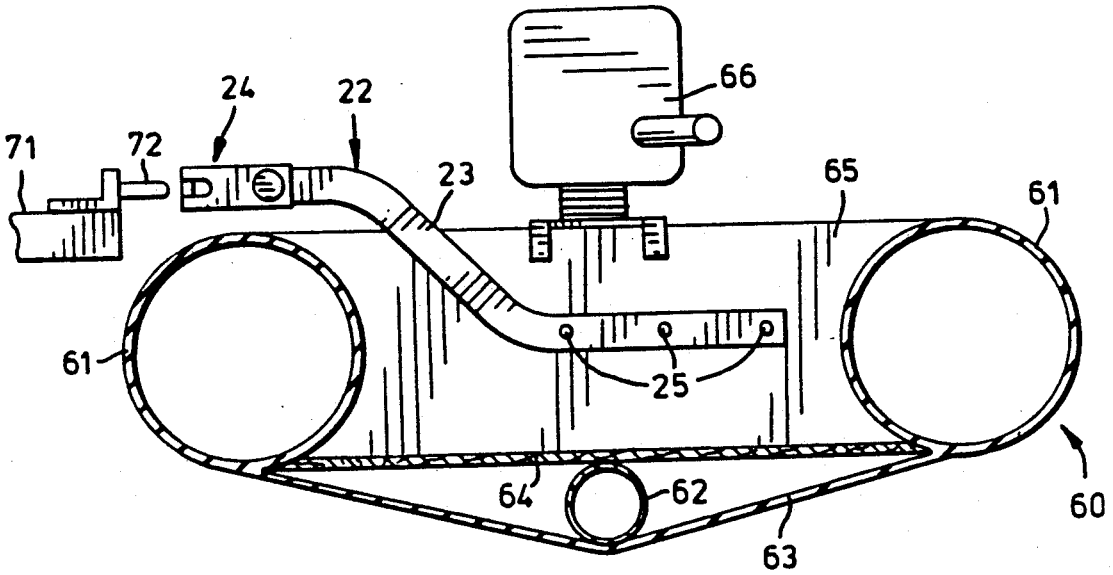
FIG. 2 is a cross-section of the dinghy of FIG. 1, taken along the plane indicated by line 2—2.
Figure 3:
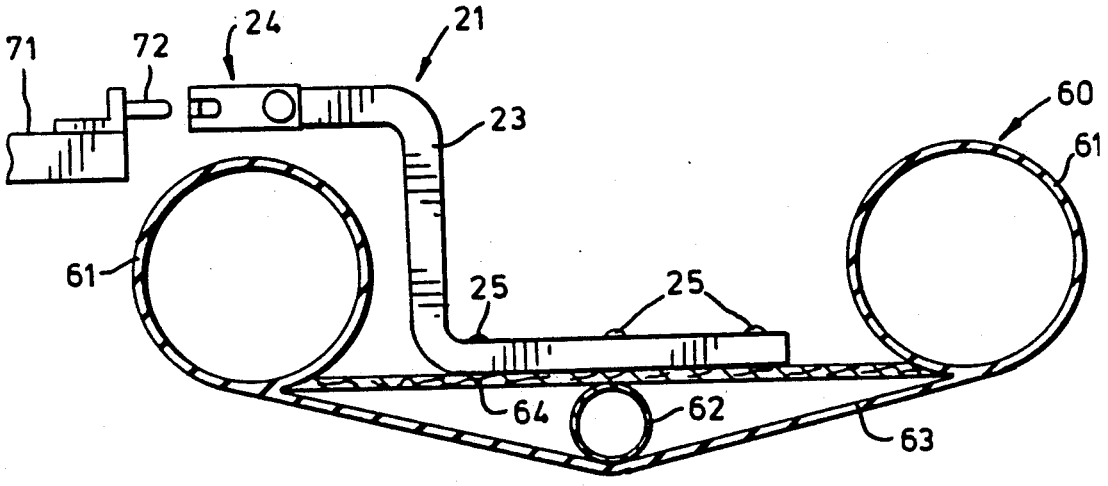
FIG. 3 is a cross-section of the dinghy of FIG. 1, taken along the plane indicated by line 3—3.

Referring first to FIGS. 1–3, a dinghy 60 comprises a single "U"-shaped pontoon 61 having substantially parallel opposing port and starboard portions. A hull membrane 63 extends across the bottom. A rigid floor 64 extends between and is held securely by the under parts of the inner sides of the opposing port and starboard portions of the pontoon. A rigid transom 65 also extends between and is held securely by the inner sides of opposing portions of the pontoon, at least partially by the under parts thereof. An outboard motor 66 is secured to the transom 65. An inflatable keel 62 extends longitudinally between the floor 64 and the hull membrane 63.

In the background, a yacht 70 has a swim deck 71 from which two rings 72 extend rearwardly.

The dinghy 60 is equiped with two brackets 20 of the present invention. The aft bracket 22 is of a first embodiment, while the forward bracket 21 is of a second embodiment. The aft bracket 22 is designed to be mounted to the dinghy 60 by fastening it to the transom 65. The forward bracket 21 is designed to be mounted to the dinghy 60 by fastening it to the floor 64. The two brackets are otherwise similar and for the sake of brevity and clarity like parts are given a single reference number and a single description. Each of the brackets 20 compises a member 23 which is adapted to fit over the pontoon 61 of the dinghy 60. One end of the member 23 which extends outwardly above the pontoon 61 has a clasp 24 adapted to receive and hold one of the rings 72 extending rearwardly of the yacht 70. Bolts 25 penetrate through the members 23 to mount the bracket 20 to the dinghy 60 by fastening it either to the transom 65 or the floor 64. The member 23 is made of square tubular stainless steel.

Figure 4:
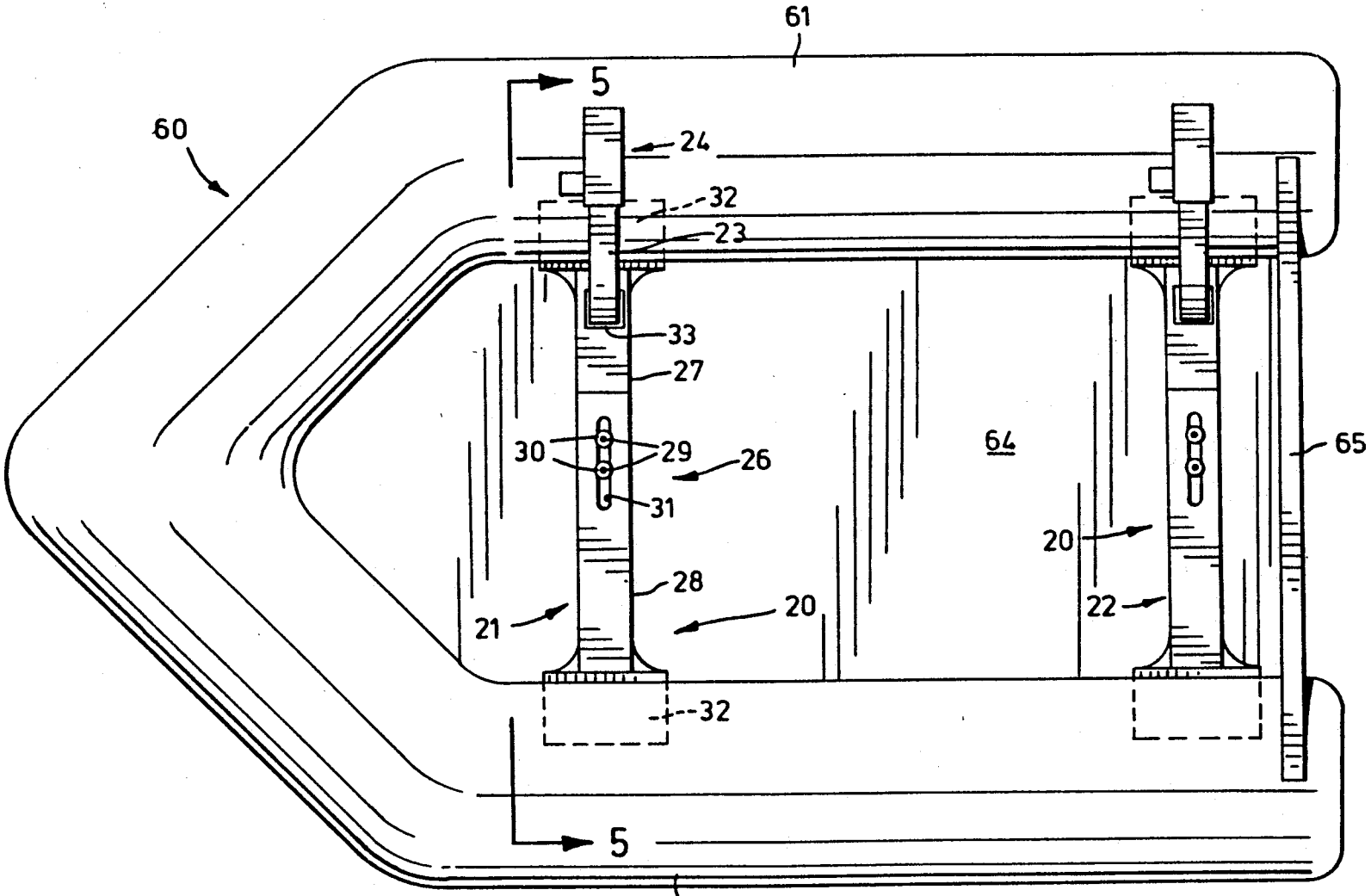
FIG. 4 is a top view of an inflatable dinghy equipped with brackets of a third embodiment of the present invention.
Figure 5:
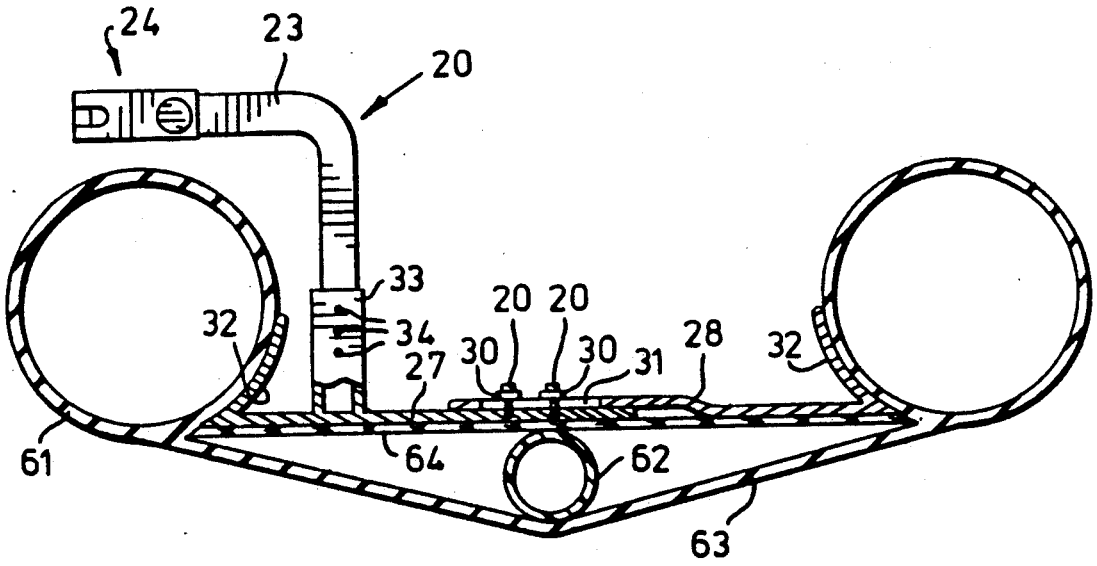
FIG. 5 is a cross-section of the dinghy of FIG. 4, taken along the plane indicated by line 5—5.
Figure 6:
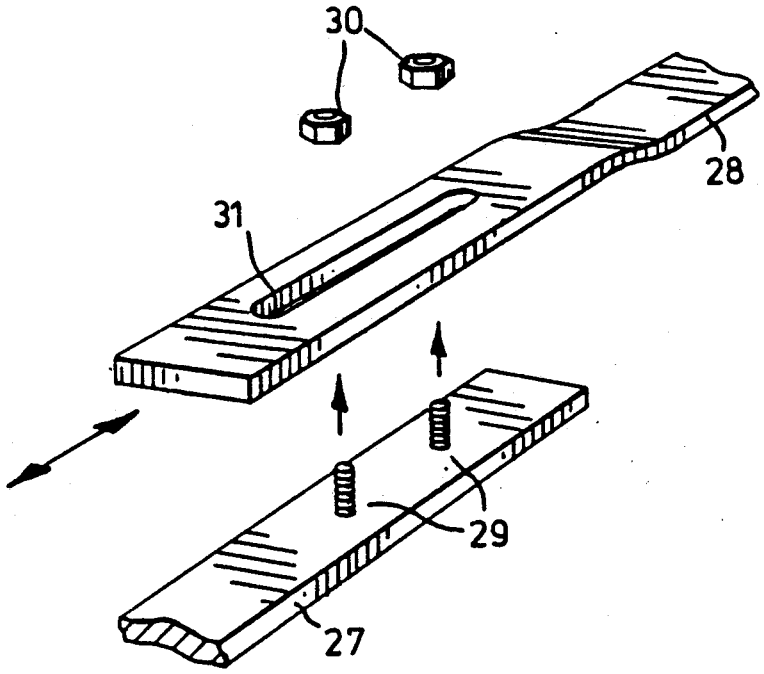
FIG. 6 is an enlarged detailed perspective view of a portion of the bracket of FIG. 4.
Figure 7:
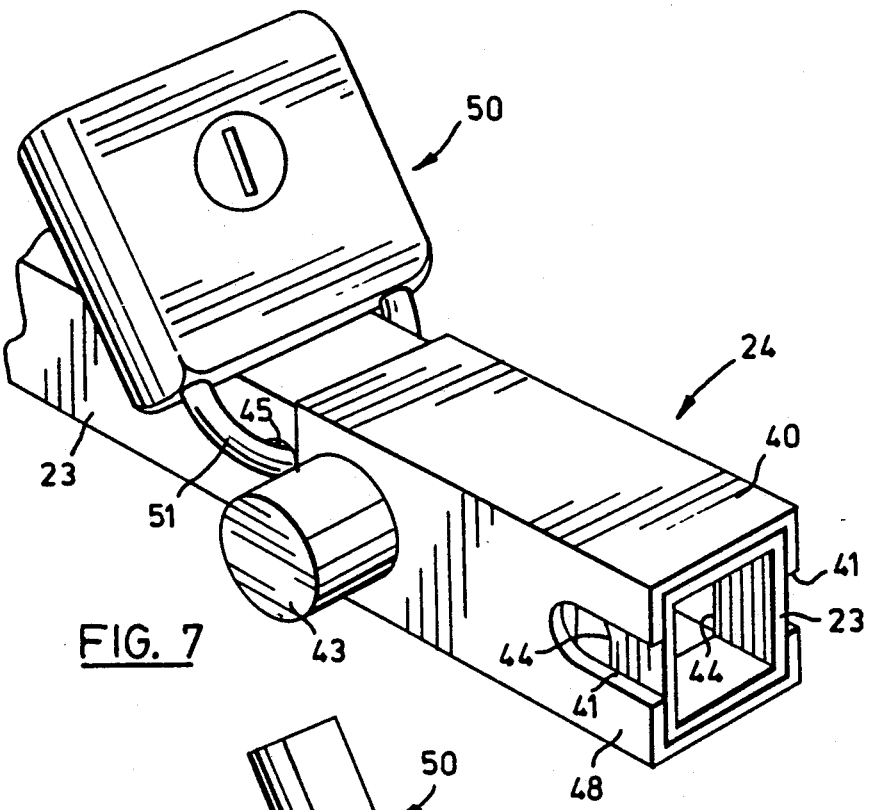
FIG. 7 is a perspective view of the clasp portion of a bracket of one embodiment of the present invention, shown in the closed position and in combination with a padlock.
Figure 8:
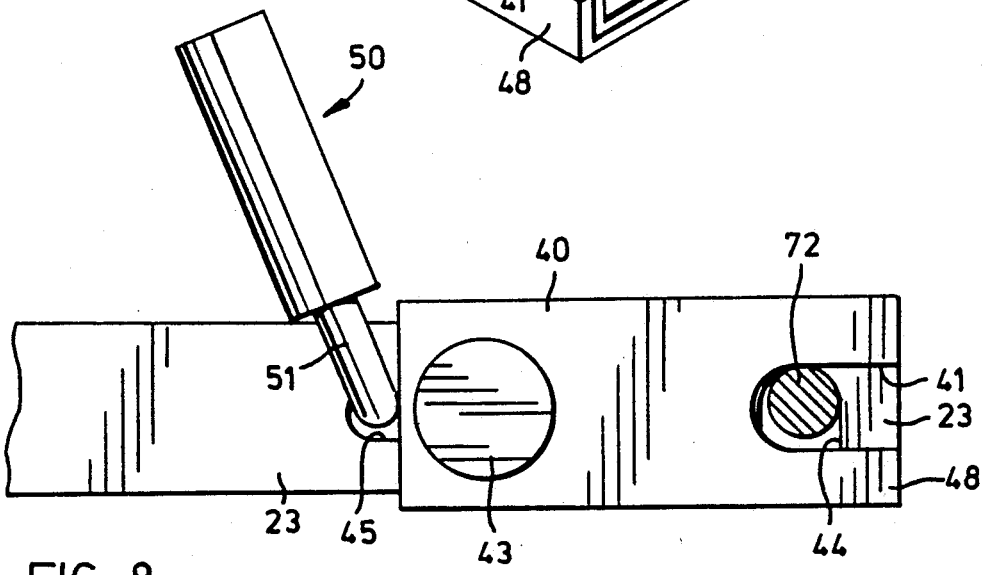
FIG. 8 is a side view of the clasp of FIG. 7, shown secured to a ring.
Figure 9:
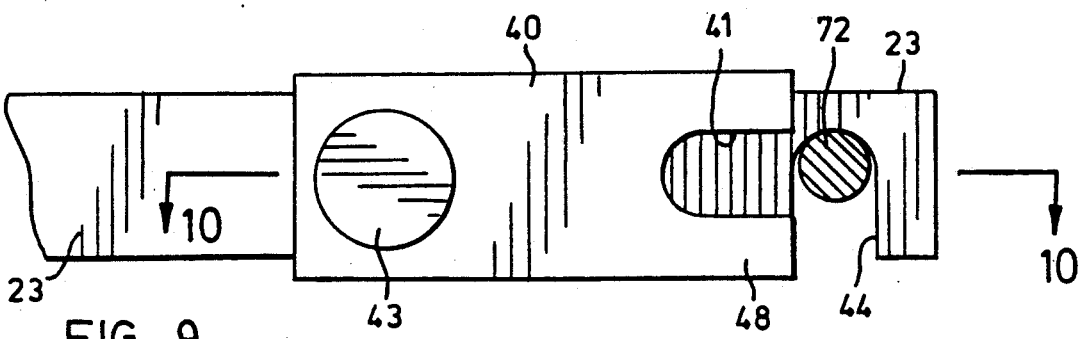
FIG. 9 is the same as FIG. 8 but with the clasp shown in open position after removal of the padlock.
Figure 10:
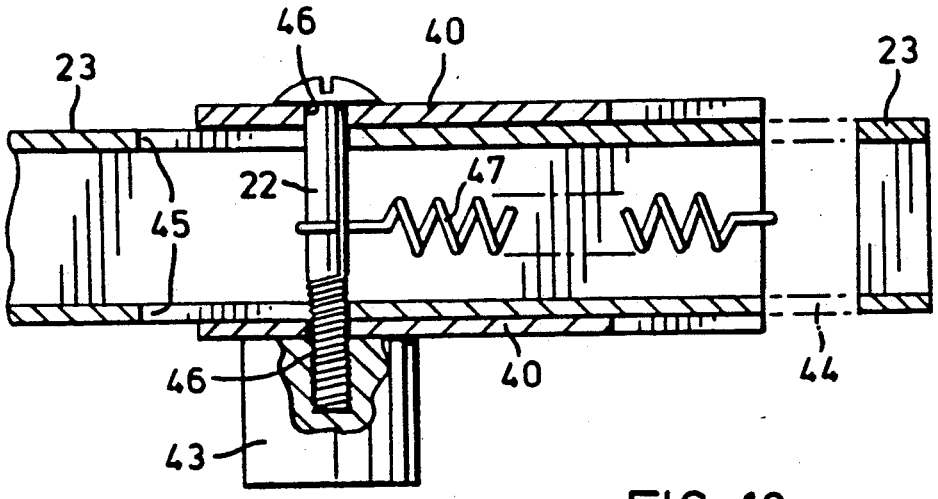
FIG. 10 is a cross-section of the clasp of FIG. 9, taken along the plane indicated by the line 10—10.

In FIGS. 4–6 an alternate embodiment of a bracket of the present invention is shown. Again, for brevity and simplicity like parts are given the same number and their description is not repeated. As shown in FIG. 4, the forward bracket 21 and the aft bracket 22 are identical. These brackets 20 each have a base 26 which extends between and is held by opposing portions of the pontoons 61. The base 26 comprises a first basal arm 27 and a second basal arm 28 which are slidably connected to each other by means of threaded pins 29 which extend through holes in the first basal arm 27 and through a slot 31 in the second basal arm 28 and which are fitted with nuts 30. When the nuts 30 are loosened, the base 26 can be collapsed to a length shorter than the shortest distance between the opposing portions of the pontoon 61 to facilitate positioning of the bracket 20. The base can then be extended to a length as long as the longest distance between the opposing portions of the pontoon 61 and the nuts 30 can be tightened so that the curved end portions 32 of the base are held securely between and by the under parts of the inner sides of the opposing portions of the pontoon 61. A sleeve 33 extends upwardly from the first basal arm 27 and is adapted to receive the member 23. The position of the member 23 within the sleeve 33 may be adjusted by means of a pin extending through a hole in the member 23 and one of several holes 34 in the sleeve 33. This enables the height of the bracket 20 to be adjusted. The member 23 may also be removed easily and stored separately when not in use.

FIGS. 7–10 show the clasp portion 24 of an embodiment of the invention. The member 23 has notches 44 which extend upwardly from the lower side and which are adapted to receive therein one of the rings 72. A latch 40 is provided by a larger square tubular section forming a sleeve which is mounted slidably to the member 23. The latch 40 is movable between a first advanced position and a second retracted position. The latch 40 also has notches 41 adapted to receive a ring 72. A portion of the latch 40 beneath the notch 41 forms a catch 48. When the latch is in its advanced position the catch 48 extends across and closes the notch 44 of the member 23 and when the latch 40 is in its retracted position, the catch 48 is withdrawn from and leaves open the notch 44 of the member 23.

A bolt 42 extends through holes 46 in the latch 40 and through channels 45 in the member 23 and into a handle 43 which extends outwardly from one side of the latch 40. A spring 47 is held in tension between the bolt 42 and the bottom edge of the member 23 adjacent the notch 44 of the member 23. The spring 47 urges the latch 40 normally to its advanced position, but the urging force of the spring 47 can be easily overcome by manipulation of the handle 43 to move the latch 40 to its withdrawn position. When the latch 40 is in its advanced position, the channels 45 in the member 23 are adapted to receive the shackel 51 of a conventional padlock 50 which blocks movement of the latch 40 from its advanced position to its withdrawn position. In this way, the clasp 24 can be locked to a ring 72 with a conventional padlock.

Figure 11:
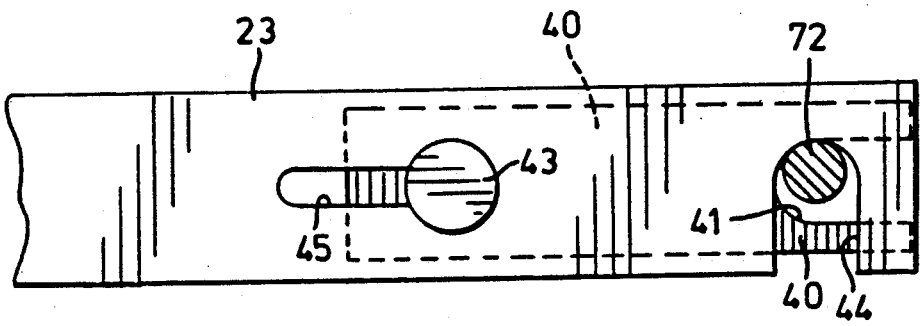
FIG. 11 is a side view of the clasp portion of a bracket of an alternate embodiment, shown in closed position and secured to a ring.
Figure 12:
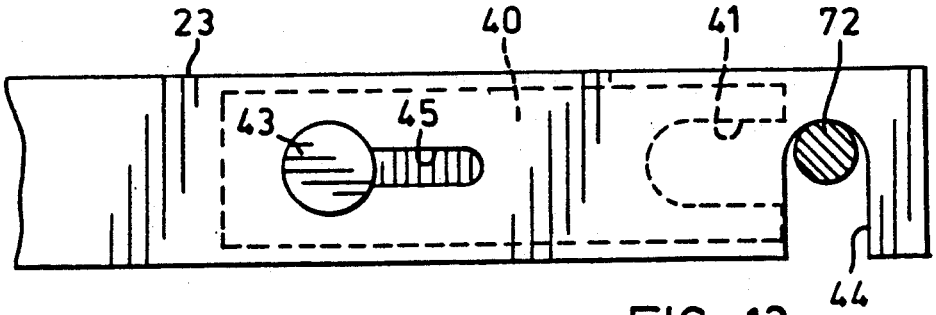
FIG. 12 is the same as FIG. 11, but with the clasp shown in open position.

In the embodiment shown in FIGS. 11 and 12, the clasp 24 is provided with a latch 40 which forms an internal sleeve, rather than an external sleeve. For the sake of simplicity and brevity like parts are given the same numbers and their description is not repeated.

In use, a pair of brackets of the present invention are mounted to an inflatable dinghy. The dinghy may be secured to a yacht by hooking the bracket clasps to a pair of rings extending rearwardly from the swim deck or transom of the yacht. The dinghy may be towed in this fashion, and it may also be lifted against the transom by means of a line extending downwardly from the transom of the yacht to the outer portion of the dinghy, preferably to a hook or cleat or eye fastened to the transom or the floor of the dinghy.

While the present invention has been described with reference to certain preferred embodiments, it will of course be recognized that many modifications and variations of the invention are possible. For example, while the preferred embodiments are described as being fabricated of tubular stainless steel, other materials having suitable properties of strength and corrosion resistance could also be used. The bracket member need not be a hollow tube. A solid bar, or plate, or molding could be substituted. The latch of the clasp also need not be slidably mounted. It could, for example, be pivotally mounted. In fact, the positions of the clasps and the rings could be reversed. All such variations and modifications are contemplated within the broad scope of the invention.

I claim:

1. A bracket for securing an inflatable dinghy having opposing pontoon portions to a yacht, said bracket comprising:

a member adapted to fit over one of said pontoon portions, and having at one end thereof means for removably securing said member to said yacht; and mounting means for mounting said member to said dinghy such that said member is directly or indirectly held by and between the under parts of the inner sides of said opposing pontoon portions.

2. A bracket as recited in claim 1, for use on a dinghy having a rigid transom held at least partially by and between the under parts of the inner sides of said opposing pontoon portions, wherein said mounting means comprises fastening means for fastening said member to said transom.

3. A bracket as recited in claim 2, wherein said fastening means comprise threaded fasteners which can penetrate said member and said transom.

4. A bracket as recited in claim 2 for use with a yacht having rings mounted to its transom or swim deck, wherein said securing means comprises a clasp adapted to fit onto one of said rings, said clasp comprising:

an element having a transverse notch extending inwarding on one side thereof adapted to receive said ring; and a latch mounted to said element movable between a first position and a second position having a part which extends across and closes said notch of said element when said latch is in said first position and which is withdrawn from and leaves open said notch when said latch is in said second position.

5. A bracket as recited in claim 4, wherein said clasp element is provided by said member, and wherein said latch is provided by a sleeve slidably mounted to said member.

6. A bracket as recited in claim 1, for use on a dinghy having a rigid floor held by and between the under parts of the inner sides of said opposing pontoon portions, wherein said mounting means comprises fastening means for fastening said member to said floor.

7. A bracket as recited in claim 6, wherein said fastening means comprise threaded fasteners which can penetrate said member and said floor.

8. A bracket as recited in claim 6 for use with a yacht having rings mounted to its transom or swim deck, wherein said securing means comprises a clasp adapted to fit onto one of said rings, said clasp comprising:

an element having a transverse notch extending inwarding on one side thereof adapted to receive said ring; and a latch mounted to said element movable between a first position and a second position having a part which extends across and closes said notch of said element when said latch is in said first position and which is withdrawn from and leaves open said notch when said latch is in said second position.

9. A bracket as recited in claim 8, wherein said clasp element is provided by said member, and wherein said latch is provided by a sleeve slidably mounted to said member.

10. A bracket as recited in claim 1, wherein said mounting means comprises a base which is adapted to fit between and be held by the under parts of the inner sides of said pontoon portions, and wherein said member extends upwardly from said base.

11. A bracket as recited in claim 10, wherein said base comprises first and second arms slidably connected to each other such that said base can be collapsed to a length shorter than the shortest distance between said pontoon portions and can be extended to a length as long as the longest distance between said pontoon portions.

12. A bracket as recited in claim 11, wherein said member is removably connected to said base.

13. A bracket as recited in claim 12, wherein said member fits within a sleeve extending upwardly from said base.

14. A bracket as recited in claim 13, wherein the position of said member within said sleeve is adjustable so that the height of said member can be adjusted.

15. A bracket as recited in claim 10 for use with a yacht having rings mounted to its transom or swim deck, wherein said securing means comprises a clasp adapted to fit onto one of said rings, said clasp comprising:

an element having a transverse notch extending inwarding on one side thereof adapted to receive said ring; and a latch mounted to said element movable between a first position and a second position having a part which extends across and closes said notch of said element when said latch is in said first position and which is withdrawn from and leaves open said notch when said latch is in said second position.

16. A bracket as recited in claim 15, wherein said clasp element is provided by said member, and wherein said latch is provided by a sleeve slidably mounted to said member.

17. A bracket as recited in claim 1 for use with a yacht having rings mounted to its transom or swim deck, wherein said securing means comprises a clasp adapted to fit onto one of said rings, said clasp comprising:

an element having a transverse notch extending inwarding on one side thereof adapted to receive said ring; and a latch mounted to said element movable between a first position and a second position having a part which extends across and closes said notch of said element when said latch is in said first position and which is withdrawn from and leaves open said notch when said latch is in said second position.

18. A bracket as recited in claim 17, wherein said element of said clasp also has a hole adapted to receive the shackel of a lock positioned so that movement of said latch from said first position to said second position is blocked.

19. A bracket as recited in claim 18, wherein said clasp further comprises a spring urging said latch normally to said first position.

20. A bracket as recited in claim 17, wherein said clasp element is provided by said member, and wherein said latch is provided by a sleeve slidably mounted to said member.

* * * * *